US008028560B2

(12) United States Patent
Badiali

(10) Patent No.: US 8,028,560 B2
(45) Date of Patent: Oct. 4, 2011

(54) HANDHELD BRAKE

(75) Inventor: John A. Badiali, Englewood, FL (US)

(73) Assignee: Custom Spec Engineering, Inc., Englewood, FL (US)

( * ) Notice: Subject to any disclaimer, the term of this patent is extended or adjusted under 35 U.S.C. 154(b) by 68 days.

(21) Appl. No.: 12/423,262

(22) Filed: Apr. 14, 2009

(65) Prior Publication Data

US 2009/0255314 A1 Oct. 15, 2009

Related U.S. Application Data

(60) Provisional application No. 61/044,738, filed on Apr. 14, 2008.

(51) Int. Cl.
*B21D 5/04* (2006.01)

(52) U.S. Cl. ..... 72/319; 72/388; 81/420

(58) Field of Classification Search ..... 72/310, 72/319, 320, 388; 81/420
See application file for complete search history.

(56) References Cited

U.S. PATENT DOCUMENTS

| | | | | | |
|---|---|---|---|---|---|
| 15,964 | A | * | 10/1856 | Burling | 72/319 |
| 2,732,744 | A | * | 1/1956 | Kuchman et al. | 72/320 |
| 3,248,921 | A | * | 5/1966 | Trout | 72/319 |
| 3,354,759 | A | | 11/1967 | Cook | |
| 3,604,244 | A | * | 9/1971 | Thomas | 72/459 |
| 4,386,543 | A | * | 6/1983 | Walker, Jr. | 81/420 |
| 4,559,805 | A | * | 12/1985 | McClure | 72/319 |
| D297,103 | S | * | 8/1988 | Parish, Sr. | D8/52 |
| 5,222,386 | A | * | 6/1993 | Jones, Jr. | 72/319 |
| 6,752,045 | B2 | | 6/2004 | Badiali | |
| 2009/0255314 | A1 | * | 10/2009 | Badiali | 72/319 |

* cited by examiner

*Primary Examiner* — David Jones
(74) *Attorney, Agent, or Firm* — Gifford, Krass, Sprinkle, Anderson & Citkowski , P.C.

(57) ABSTRACT

Vise pliers with duck bill jaws and a brake attached thereto, having utility as a vise pliers tool and/or as a handheld sheet metal brake.

1 Claim, 4 Drawing Sheets

HANDHELD BRAKE

CROSS-REFERENCE TO RELATED APPLICATIONS

This application claims priority of U.S. Provisional Patent Application Ser. No. 61/044,738, filed Apr. 14, 2008, which is incorporated herein by reference.

FIELD OF THE INVENTION

The present invention is directed to vise pliers and more particularly to vise pliers having duck bill jaws and a brake attached

BACKGROUND OF THE INVENTION

Hand pliers tools are currently available which have knee joint lever arrangements that permit a user to lock the clamping jaws of the tool onto an object placed between said jaws. Such type of vise pliers, commonly referred to as "vise grips," typically have an adjustment mechanism whereby the user can adjust the distance between the clamping jaws when in the locked position. In addition, such types of vise pliers can include jaws in the form of clamping plates, commonly referred to as duck bill jaws. Vise pliers with duck bill jaws can be used to clamp onto sheet metal, plate, and other relatively flat objects and provide a relatively wide area of clamping force and support. In some instances, vise pliers with duck bill jaws can be clamped onto a relatively flat object and used to bend, sometimes referred to as "brake," the object. However, the use of vise pliers with duck bill jaws requires the user to hold or clamp the portion of the object extending from the duck bill jaws in order for leverage to be applied. As such, it would be desirable for vise pliers having duck bill jaws to include a mechanism wherein an object clamped within the duck bill jaws could be bent without having to place the extended portion of the object in a vise, clamp and the like.

SUMMARY OF THE INVENTION

The present invention includes vise pliers with duck bill jaws and a brake attached thereto. As such, the present invention has utility as a vise pliers tool and/or as a handheld sheet metal brake.

BRIEF DESCRIPTION OF THE DRAWINGS

A better understanding of the present invention can be had upon reference to the following drawings in which.

DETAILED DESCRIPTION OF THE PREFERRED EMBODIMENTS

Figure 1:
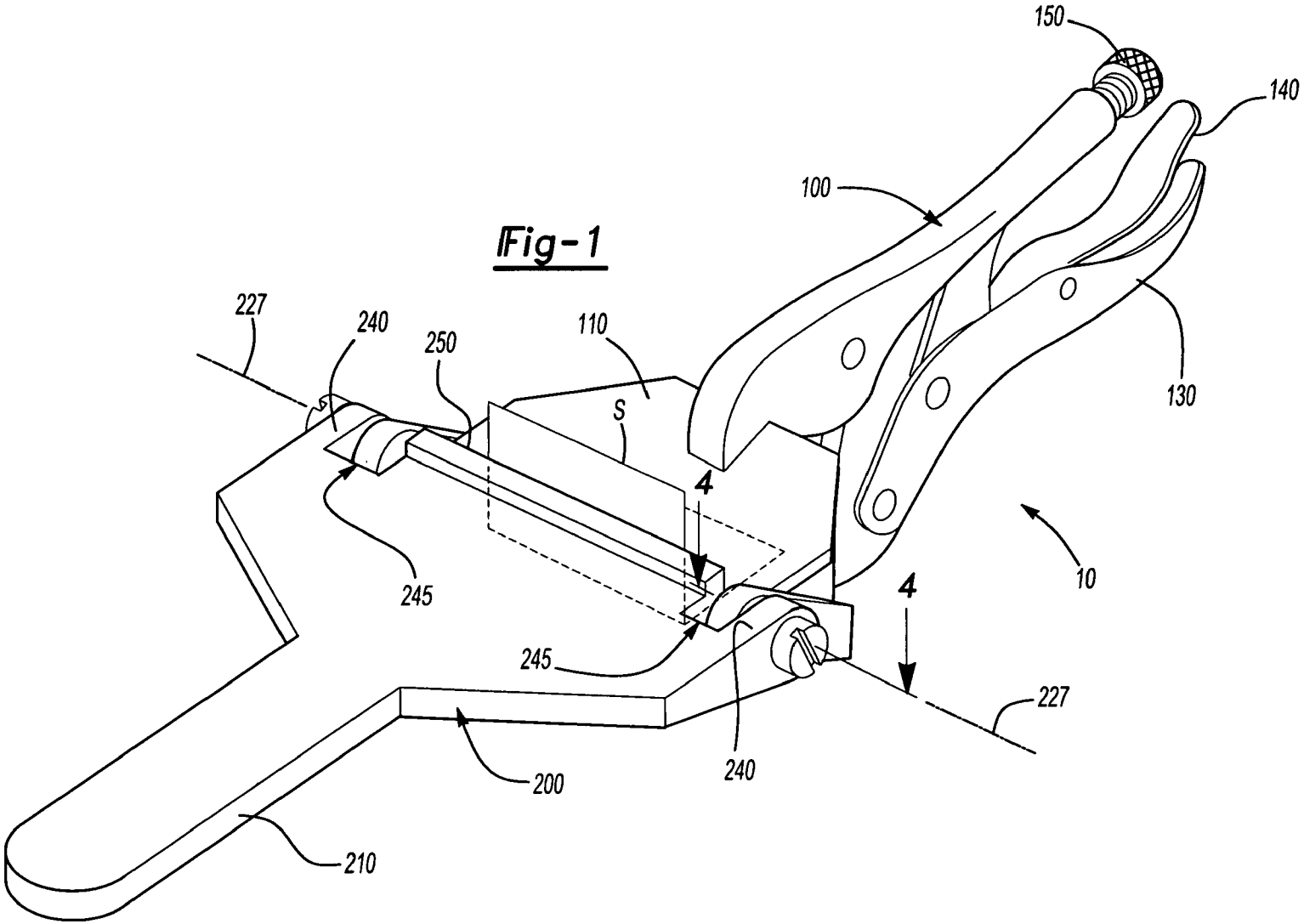
FIG. 1 is a top perspective view of a handheld brake of the present invention in use.
Figure 2:
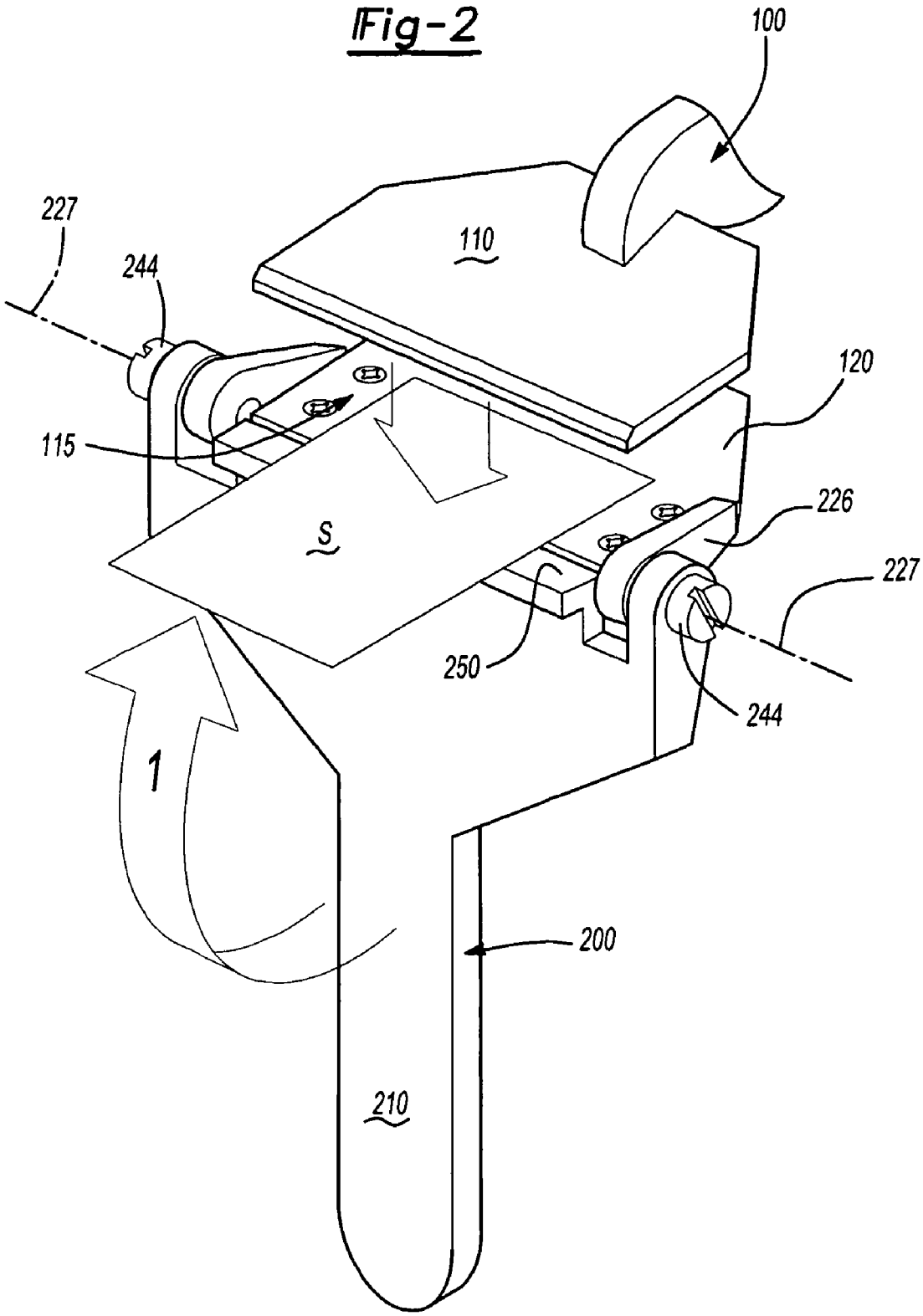
FIG. 2 is a view similar to FIG. 1 but illustrating the handheld brake prior to use to bend a piece of sheet metal S.

Turning now to FIGS. 1-6, an embodiment of the present invention is shown generally at 10. The embodiment includes a tool in the form of a vise pliers 100 with a brake 200 attached thereto. The vise pliers 100 can include a first gripping member in the form of a top duck bill jaw 110 and a second gripping member in the form of a bottom duck bill jaw 120. As known to be present with such types of vise pliers, a pressure lever 130, a release lever 140 and an adjustment bolt 150 can be included. Such types of vise pliers are known to those skilled in the art, for example as described and illustrated in U.S. Pat. No. 3,354,759, which is incorporated herein by reference.

Between the top jaw 110 and the bottom jaw 120 is defined a clamping area 115. The adjustment of the distance between the top jaw 110 and bottom jaw 120 when the vise pliers 100 are in the closed and locked position is afforded by the adjustment bolt 150. The adjustment bolt 150 affords for the positioning of a lever arrangement (not shown) which subsequently adjusts the distance between the jaws 110 and 120 in the clamped position. Once the adjustment of the adjustment bolt 150 affords for a desired distance and clamping pressure between the top jaw 110 and the bottom jaw 120, an object held there between can be worked upon or used by a user and then released by depressing the release lever 140.

Figure 3:
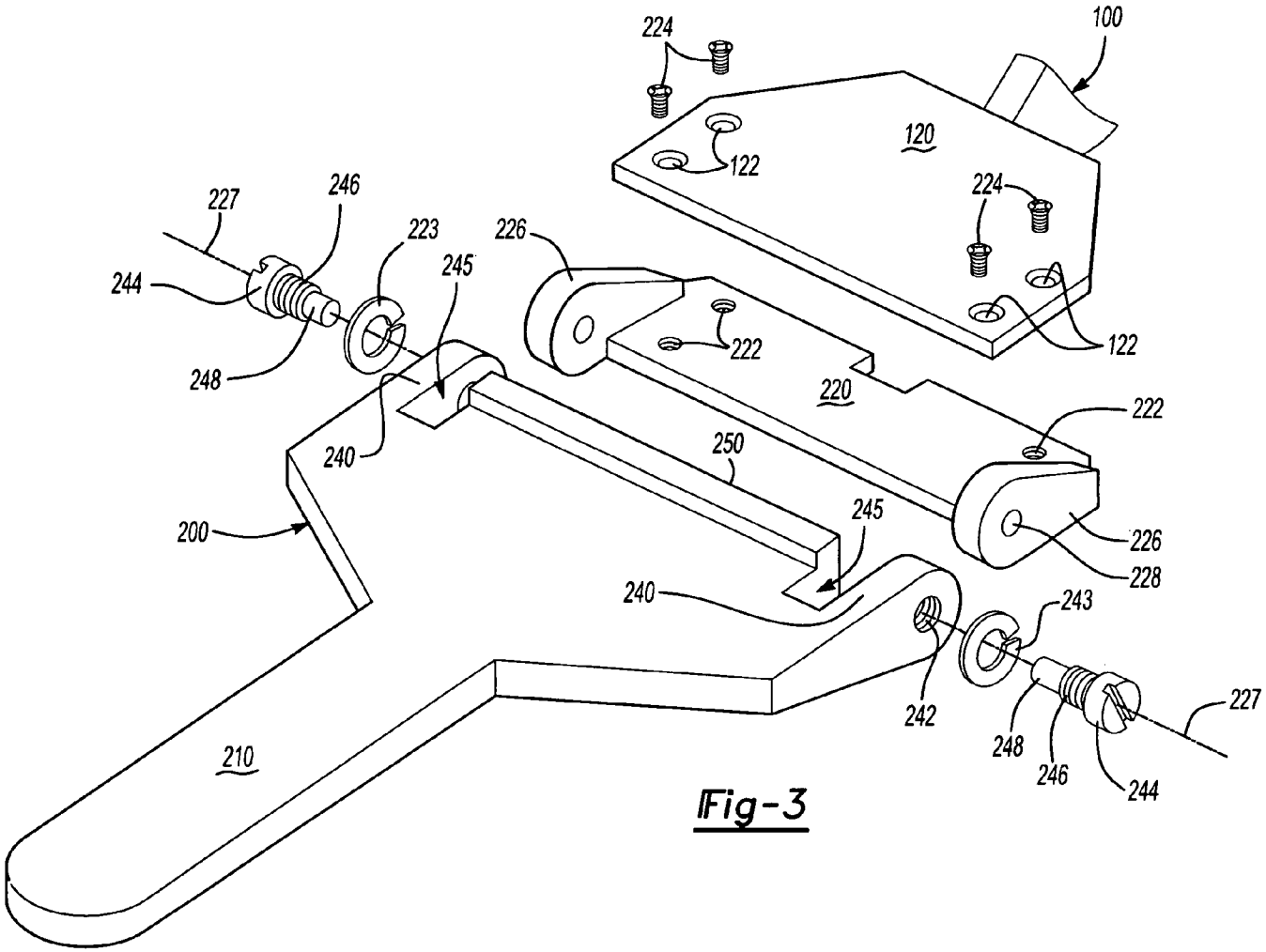
FIG. 3 is a fragmentary exploded view of the handheld brake shown in FIG. 1.
Figure 4:
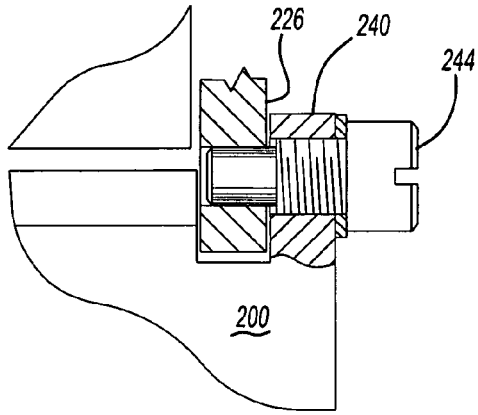
FIG. 4 is a fragmentary view partially in section and taken substantially at line 4-4 of FIG. 1.
Figure 5:
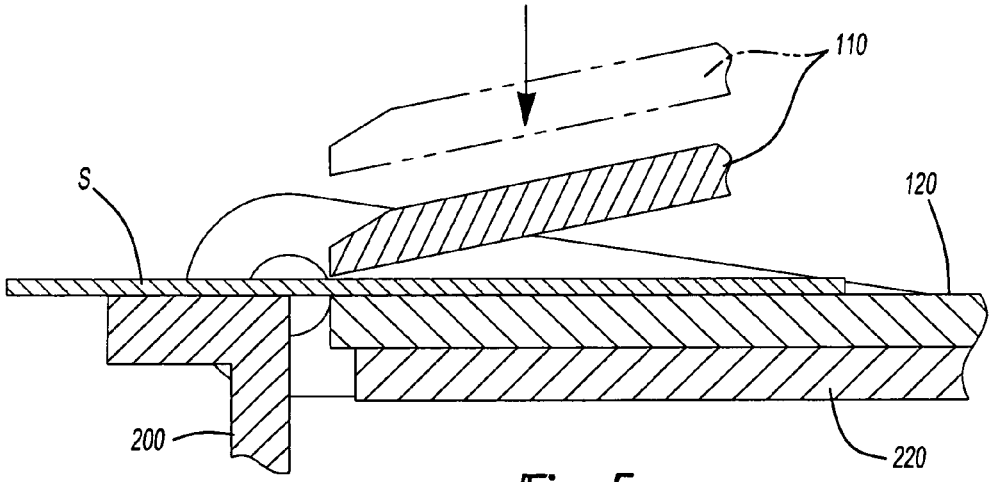
FIG. 5 is a fragmentary cross sectional view illustrating the handheld brake in the position shown in FIG. 2.
Figure 6:
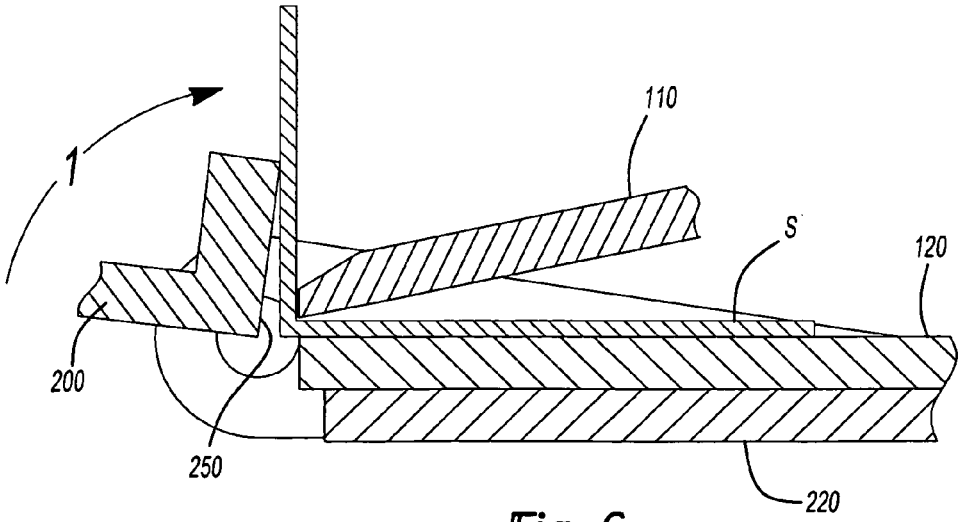
FIG. 6 is a fragmentary cross sectional view illustrating the handheld brake in the position shown in FIG. 1.

The brake 200 is rotatably mounted to the vise pliers 100 using a mounting plate 220. The mounting plate 220 is fixedly attached to the bottom jaw 120 using any method known to those skilled in the art, illustratively including welding, screws, bolts and nuts and the like. In some instances, the mounting plate 220 can include apertures 222 with screws 224 affording mounting of the plate 220 to the bottom jaw 120 as illustrated in FIG. 3. The mounting plate 220 also has a flange 226 that extends from the mounting plate 220 in a generally normal direction on the proximal end of the mounting plate 220. The flange 226 can also extend beyond the bottom jaw 120 and afford for a pivot axis 227. About the pivot axis 227 can be an aperture 228. Using the aperture 228, the brake 200 with a flange 240 can be attached to the mounting plate 220 using a pin 244 located through an aperture 242. The pin 244 can be a bolt, screw, and the like. In some instances, the pin 244 can include a threaded portion 246 and a non-threaded portion 248. The threaded portion 246 affords for screwing the pin 244 into the aperture 242, particularly if the aperture 242 is threaded to match threaded portion 246. The un-threaded portion 248 can fit at least partially within the aperture 228 of the mounting plate 220 and thereby afford for rotatable movement of the brake 200 about the pivot axis 227. An optional washer 243 can also be included. Thus, the attachment of the brake 200 to the mounting plate 220 about the pivot axis 227 affords for the swinging movement of the brake 200 about the clamping area 115 between the top jaw 110 and the bottom jaw 120. In some instances, the brake 200 includes a braking surface 250 as illustrated in the figures.

Upon placement of a relatively flat object, for example a piece of sheet metal S, between the top jaw 110 and the bottom jaw 120, the sheet metal S can be firmly clamped there between. Once clamped, the brake 200 can be grasped using handle 210 and rotated about the pivot axis 227 in a first direction 1. Rotation of the brake 200 about the pivot axis 227 in the first direction 1 results in the bending or braking of the sheet metal S being held within the clamping area 115. After the sheet metal S has been bent to a desired angle, the release lever 140 of the vise pliers 100 can be depressed, thereby causing the top jaw 110 and the bottom jaw 120 to open and affording for the sheet metal S to be removed therefrom.

The vise pliers 100 and the brake 200 can be made from any material known to those skilled in the art, illustratively including metals, alloys, high-strength plastics, ceramics and combinations thereof. In this manner, a handheld brake affording the braking of sheet metal and the like is provided.

The foregoing drawings, discussion and description are illustrative of specific embodiments of the present invention, but they are not meant to be limitations upon the practice thereof. Numerous modifications and variations of the invention will be readily apparent to those of skill in the art in view of the teaching presented herein. It is the following claims, including all equivalents, which define the scope of the invention.

I claim:

1. A tool for gripping material, the tool comprising pliers having a first handle including a first gripping member having a first distal end, and a second handle including a second gripping member having a second distal end, and wherein the first handle is rotatably mounted to the second handle so as to move the first gripping member and the second gripping member between an open position and a closed position and wherein in the open position the first gripping member is displaced relative to the second gripping member and wherein in the closed position the first gripping member and the second gripping member are pressed against each other, the tool further comprising:

a brake rotatably mounted to the first gripping member, the brake rotatable between a first position and a second position, the brake including a proximal end adjacent the first free end and wherein the proximal end is movable between the first position and the second position so as to bend material between the first and the second gripping member;

a mounting plate fixed to the first gripping member;

a flange formed at each end of said brake and said mounting plate pivotally mounted to said flanges to provide pivotal movement between said brake and said first gripping member.

* * * * *